US010290250B2

(12) United States Patent
Guo et al.

(10) Patent No.: US 10,290,250 B2
(45) Date of Patent: May 14, 2019

(54) PIXEL ARRAY AND DRIVING METHOD THEREOF, DISPLAY PANEL AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN); Pengxiang Liu, Beijing (CN); Kai Yang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 820 days.

(21) Appl. No.: 14/436,926

(22) PCT Filed: Aug. 29, 2014

(86) PCT No.: PCT/CN2014/085477
§ 371 (c)(1),
(2) Date: Apr. 20, 2015

(87) PCT Pub. No.: WO2015/123982
PCT Pub. Date: Aug. 27, 2015

(65) Prior Publication Data

US 2016/0055780 A1 Feb. 25, 2016

(30) Foreign Application Priority Data

Feb. 21, 2014 (CN) ..... 2014 1 0060329

(51) Int. Cl.
*G09G 3/20* (2006.01)

(52) U.S. Cl.
CPC ... *G09G 3/2003* (2013.01); *G09G 2300/0452* (2013.01); *G09G 2340/0457* (2013.01)

(58) Field of Classification Search
None
See application file for complete search history.

(56) References Cited

U.S. PATENT DOCUMENTS 4,437,122 A * 3/1984 Walsh ..... G06K 15/02 345/419
5,311,337 A 5/1994 McCartney, Jr.
(Continued)

FOREIGN PATENT DOCUMENTS

CN 1637560 A 7/2005
CN 101009083 A 8/2007
(Continued)

OTHER PUBLICATIONS

International Search Report dated Apr. 8, 2015 issued in corresponding International Application No. PCT/CN2014/087586.
(Continued)

*Primary Examiner* — Srilakshmi K Kumar
*Assistant Examiner* — Karin Kiyabu
(74) *Attorney, Agent, or Firm* — Nath, Goldberg & Meyer; Joshua B. Goldberg; Stanley N. Protigal

(57) ABSTRACT

The present invention provides a pixel array which comprises a plurality of pixel units, each of the plurality of pixel units comprises a plurality of sub-pixels having different colors, wherein, a horizontal-to-vertical ratio of each sub-pixel is in a range of 1:2 to 1:1. The present invention further provides a driving method of a pixel array, a display panel including the pixel array, and a display device including the display panel.

3 Claims, 8 Drawing Sheets

(56) References Cited

U.S. PATENT DOCUMENTS 5,363,213 A * 11/1994 Coward ..... G06T 3/4023 348/390.1
5,673,376 A * 9/1997 Ray ..... G06T 3/40 345/427
6,501,483 B1 * 12/2002 Wong ..... G06T 11/001 345/441
6,661,463 B1 * 12/2003 Geshwind ..... H04N 5/843 348/384.1
6,664,955 B1 * 12/2003 Deering ..... G06T 3/4007 345/418
6,914,649 B2 7/2005 Liu
6,947,058 B1 * 9/2005 Elmquist ..... G06T 11/001 345/582
7,408,559 B2 * 8/2008 Keshet ..... G06T 11/203 345/611
7,518,618 B2 * 4/2009 Loce ..... G06T 11/203 345/596
7,705,855 B2 * 4/2010 Brown Elliott ..... H04N 1/56 345/589
8,565,548 B2 * 10/2013 Washio ..... G06T 5/002 345/596
8,587,621 B2 * 11/2013 Malka ..... G09G 3/3607 345/32
9,256,929 B2 * 2/2016 Fu ..... G06T 5/20
9,812,054 B2 * 11/2017 Yang ..... G09G 3/2011
2001/0013873 A1 * 8/2001 Wong ..... G06T 11/203 345/629
2002/0005862 A1 * 1/2002 Deering ..... G06F 3/011 345/694
2002/0140655 A1 * 10/2002 Liang ..... G09G 3/2003 345/89
2003/0011603 A1 * 1/2003 Koyama ..... G09G 5/24 345/470
2003/0085906 A1 * 5/2003 Elliott ..... G09G 3/20 345/613
2003/0160915 A1 * 8/2003 Liu ..... G02F 1/133514 349/106
2006/0158466 A1 * 7/2006 Chien ..... G09G 3/2074 345/694
2006/0170712 A1 * 8/2006 Miller ..... H01L 27/3211 345/695
2008/0049048 A1 * 2/2008 Credelle ..... G09G 3/2074 345/690
2008/0278522 A1 * 11/2008 Furihata ..... G09G 3/2003 345/694
2009/0148063 A1 * 6/2009 Hosoda ..... G06K 9/40 382/266
2010/0118045 A1 * 5/2010 Brown Elliott .... G02B 27/2214 345/589
2010/0283803 A1 11/2010 Chou
2012/0163730 A1 * 6/2012 Washio ..... G06T 5/002 382/269
2013/0010235 A1 1/2013 Hirosawa et al.
2013/0027437 A1 1/2013 Gu
2013/0050528 A1 * 2/2013 Hsu ..... H04N 9/045 348/234
2013/0155034 A1 * 6/2013 Nakayama ..... G09F 9/35 345/204
2015/0371583 A1 * 12/2015 Guo ..... G09G 3/2074 345/694
2016/0019825 A1 * 1/2016 Guo ..... G09G 3/2003 345/694
2016/0027404 A1 * 1/2016 Nakanishi ..... G09G 5/02 345/590
2016/0329026 A1 * 11/2016 Lu ..... G09G 3/20
2016/0371848 A1 * 12/2016 Liu ..... G09G 3/20
2016/0379533 A1 * 12/2016 Guo ..... G09G 3/20 345/694
2016/0379540 A1 * 12/2016 Guo ..... G09G 3/003 345/694
2017/0039995 A1 * 2/2017 Guo ..... G09G 3/3611
2018/0075797 A1 * 3/2018 Park ..... G09G 3/2092

FOREIGN PATENT DOCUMENTS

CN 101076844 A 11/2007
CN 101176108 A 5/2008
CN 101271571 A * 9/2008
CN 101303842 A 11/2008
CN 101393366 A 3/2009
CN 101719037 A 6/2010
CN 101937155 A 1/2011
CN 102073175 A 5/2011
CN 202285072 U 6/2012
CN 102903318 A 1/2013
CN 103163683 A 6/2013
CN 103278960 A 9/2013
CN 103777393 A 5/2014
CN 103778882 A 5/2014
CN 103824520 A 5/2014
CN 103886808 A 6/2014
CN 104036701 A 9/2014
CN 203931380 U 11/2014
CN 204029329 U 12/2014
JP 2012-133011 A 7/2012
JP 2014032338 A * 2/2014
WO 2008/131027 A1 10/2008

OTHER PUBLICATIONS

International Search Report dated Apr. 16, 2015 issued in corresponding International Application No. PCT/CN2015/088084.
Office Action dated Jan. 21, 2016 issued in corresponding Chinese Application No. 201410317831.1.
Office Action dated Jun. 28, 2016 issued in corresponding Chinese Application No. 201410317831.1.
Office Action dated Sep. 14, 2016 issued in corresponding Chinese Application No. 201410317831.1.
Written Opinion of the International Searching Authority dated Nov. 25, 2014 corresponding to application No. PCT/CN2014/085477.
International Search Report dated Aug. 29, 2014 corresponding to application No. PCT/CN2014/085477.
Office Action dated Dec. 21 2015 issued in corresponding Chinese Application No. 201410060329.7.

* cited by examiner

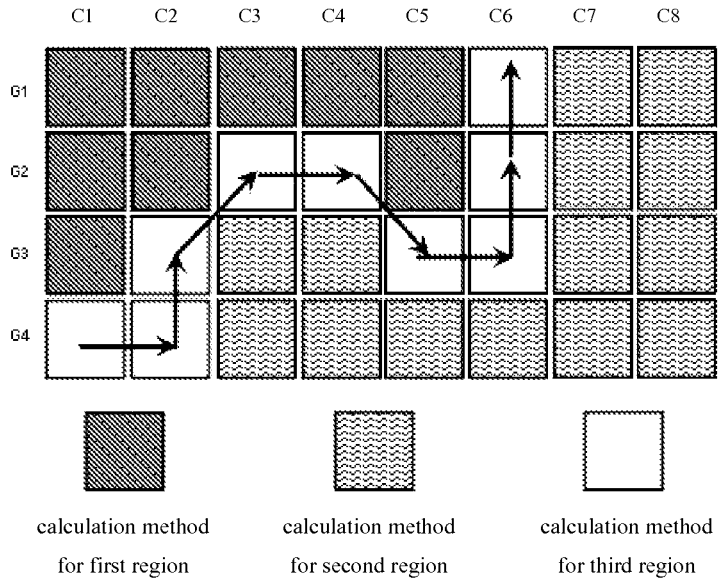

Fig. 11

(a) R
$$\begin{pmatrix} 0; & 0.2; \\ 0; & 0.8; \end{pmatrix}$$

(b) R
$$\begin{pmatrix} 0; & 0.3; \\ 0; & 0.7; \end{pmatrix}$$

(c) R
$$\begin{pmatrix} 0; & 0.3; \\ -0.1; & 0.8; \end{pmatrix}$$

(d) R
$$\begin{pmatrix} -0.1; & 0.3; \\ -0.1; & 0.9; \end{pmatrix}$$

(e) G
$$\begin{pmatrix} 0.3; & 0.5; \\ 0; & 0.2; \end{pmatrix}$$

(f) G
$$\begin{pmatrix} 0.2; & 0.6; \\ 0; & 0.2; \end{pmatrix}$$

(g) G
$$\begin{pmatrix} 0.2; & 0.7; \\ -0.1; & 0.2; \end{pmatrix}$$

(h) G
$$\begin{pmatrix} 0.1; & 0.8; \\ 0; & 0.1; \end{pmatrix}$$

(i) B
$$\begin{pmatrix} 0.8; & 0; \\ 0.2; & 0; \end{pmatrix}$$

(j) B
$$\begin{pmatrix} 0.7; & 0; \\ 0.3; & 0; \end{pmatrix}$$

(k) B
$$\begin{pmatrix} 0.8; & -0.1; \\ 0.3; & 0; \end{pmatrix}$$

(l) B
$$\begin{pmatrix} 0.9; & -0.1; \\ 0.3; & -0.1; \end{pmatrix}$$

Fig. 12

(a) R
$$\begin{bmatrix} 0.1; & 0; \\ 0.1; & 0.8; \end{bmatrix}$$

(b) R
$$\begin{bmatrix} 0.2; & 0; \\ 0.2; & 0.6; \end{bmatrix}$$

(c) R
$$\begin{bmatrix} 0.2; & 0; \\ 0.3; & 0.5; \end{bmatrix}$$

(d) R
$$\begin{bmatrix} 0.2; & -0.1; \\ 0.3; & 0.6; \end{bmatrix}$$

(e) G
$$\begin{bmatrix} 0; & 0.2; \\ 0.3; & 0.5; \end{bmatrix}$$

(f) G
$$\begin{bmatrix} 0; & 0.2; \\ 0.4; & 0.4; \end{bmatrix}$$

(g) G
$$\begin{bmatrix} 0; & 0.2; \\ 0.2; & 0.6; \end{bmatrix}$$

(h) G
$$\begin{bmatrix} -0.1; & 0.2; \\ 0.2; & 0.7; \end{bmatrix}$$

(i) B
$$\begin{bmatrix} 0; & 0.8; \\ 0.1; & 0.1; \end{bmatrix}$$

(j) B
$$\begin{bmatrix} 0; & 0.6; \\ 0.2; & 0.2; \end{bmatrix}$$

(k) B
$$\begin{bmatrix} 0; & 0.5; \\ 0.2; & 0.3; \end{bmatrix}$$

(l) B
$$\begin{bmatrix} -0.1; & 0.6; \\ 0.2; & 0.3; \end{bmatrix}$$

Fig. 13

| | R1 | R2 | R3 | G1 | G2 | G3 | B1 | B2 | B3 |
|---|---|---|---|---|---|---|---|---|---|
| (a) | [0.1; | 0.8; | 0.1;] | [0.1; | 0.8; | 0.1;] | [0.1; | 0.8; | 0.1;] |
| (b) | [0.15; | 0.7; | 0.15;] | [0.15; | 0.7; | 0.15;] | [0.15; | 0.7; | 0.15;] |
| (c) | [0.2; | 0.6; | 0.2;] | [0.2; | 0.6; | 0.2;] | [0.2; | 0.6; | 0.2;] |
| (d) | [0.25; | 0.5; | 0.25;] | [0.25; | 0.5; | 0.25;] | [0.25; | 0.5; | 0.25;] |
| (e) | [0.1; | 0.8; | 0.1;] | [0.15; | 0.7; | 0.15;] | [0.1; | 0.8; | 0.1;] |
| (f) | [0.15; | 0.7; | 0.15;] | [0.1; | 0.8; | 0.1;] | [0.15; | 0.7; | 0.15;] |
| (g) | [0.2; | 0.6; | 0.2;] | [0.2; | 0.6; | 0.2;] | [0.25; | 0.5; | 0.25;] |
| (h) | [0.25; | 0.5; | 0.25;] | [0.25; | 0.5; | 0.25;] | [0.2; | 0.6; | 0.2;] |

Fig. 14

PIXEL ARRAY AND DRIVING METHOD THEREOF, DISPLAY PANEL AND DISPLAY DEVICE

This is a National Phase Application filed under 35 U.S.C. 371 as a national stage of PCT/CN2014/085477, filed Aug. 29, 2014, an application claiming the benefit of Chinese Application No. 201410060329.7, filed Feb. 21, 2014, the content of each of which is hereby incorporated by reference in its entirety.

FIELD OF THE INVENTION

The present invention relates to the field of display technology, and particularly relates to a pixel array, a driving method thereof, a display panel including the pixel array and a display device including the display panel.

BACKGROUND OF THE INVENTION

In a current display panel, as a common pixel design, three sub-pixels (including a red sub-pixel, a green sub-pixel and a blue sub-pixel, as shown in FIG. 1) or four sub-pixels (including a red sub-pixel, a green sub-pixel, a blue sub-pixel and a white sub-pixel) constitute one pixel for display, and physical resolution is the visual resolution.

If pixel per inch (PPI) of a display panel is small, a user would obviously feel a granular sensation (i.e., edges of a displayed image are not smooth, but serrated) when watching a display screen. With users' increasing demand on viewing experience of the display screen, the PPI of the display panel needs to be increased. An increase in PPI of the display panel may add difficulty to a manufacturing process of the display panel.

It has become an urgent technical problem to be solved in the field how to reduce the granular sensation of the display panel to achieve a display effect of a display panel with higher resolution in the same size, without adding difficulty to the manufacturing process (i.e., without increasing PPI).

SUMMARY OF THE INVENTION

An object of the present invention is to provide a pixel array, a driving method thereof, a display panel including the pixel array and a display device including the display panel. By using the driving method according to the present invention to drive the pixel array according to the present invention, the granular sensation of the display panel can be reduced, and a display effect of a display panel with higher resolution in the same size is achieved.

According to one aspect of the present invention, there is provided a pixel array comprising a plurality of pixel units, each of the plurality of pixel units comprises a plurality of sub-pixels having different colors, wherein, a horizontal-to-vertical ratio of each sub-pixel is in a range of 1:2 to 1:1.

According to an embodiment of the present invention, the pixel unit may comprise three sub-pixels having different colors, and the horizontal-to-vertical ratio of each sub-pixel is 2:3.

According to an embodiment of the present invention, the pixel array may comprise a plurality of pixel sets, each of the plurality of pixel sets comprises two pixel units in two adjacent rows and in the same column. A left boundary of each sub-pixel of the pixel unit in a lower row may be aligned with a midpoint of a bottom boundary of a corresponding sub-pixel of the pixel unit in an upper row, or a left boundary of each sub-pixel of the pixel unit in the upper row may be aligned with a midpoint of a top boundary of a corresponding sub-pixel of the pixel unit in the lower row.

According to an embodiment of the present invention, the sub-pixels may comprise red sub-pixels, green sub-pixels and blue sub-pixels, and in each pixel set: the sub-pixels of the pixel unit in the upper row may be the red sub-pixel, the blue sub-pixel and the green sub-pixel, sequentially, and the sub-pixels of the pixel unit in the lower row may be the green sub-pixel, the red sub-pixel and the blue sub-pixel, sequentially; or the sub-pixels of the pixel unit in the upper row may be the blue sub-pixel, the red sub-pixel and the green sub-pixel, sequentially, and the sub-pixels of the pixel unit in the lower row may be the green sub-pixel, the blue sub-pixel and the red sub-pixel, sequentially; or the sub-pixels of the pixel unit in the upper row may be the blue sub-pixel, the green sub-pixel and the red sub-pixel, sequentially, and the sub-pixels of the pixel unit in the lower row may be the red sub-pixel, the blue sub-pixel and the green sub-pixel, sequentially; or the sub-pixels of the pixel unit in the upper row may be the green sub-pixel, the blue sub-pixel and the red sub-pixel, sequentially, and the sub-pixels of the pixel unit in the lower row may be the red sub-pixel, the green sub-pixel and the blue sub-pixel, sequentially; or the sub-pixels of the pixel unit in the upper row may be the green sub-pixel, the red sub-pixel and the blue sub-pixel, sequentially, and the sub-pixels of the pixel unit in the lower row may be the blue sub-pixel, the green sub-pixel and the red sub-pixel, sequentially; or the sub-pixels of the pixel unit in the upper row may be the red sub-pixel, the green sub-pixel and the blue sub-pixel, sequentially, and the sub-pixels of the pixel unit in the lower row may be the blue sub-pixel, the red sub-pixel and the green sub-pixel, sequentially.

According to an embodiment of the present invention, the horizontal-to-vertical ratio of each sub-pixel may be 1:2 or 1:1.

According to an aspect of the present invention, there is provided a driving method for a pixel array, the pixel array comprises a plurality of actual pixel units, each of the plurality of actual pixel units comprises a plurality of actual sub-pixels having different colors, a horizontal-to-vertical ratio of each actual sub-pixel is in a range of 1:2 to 1:1, and the driving method comprises steps of: dividing an image to be displayed according to a theoretical pixel array comprising a plurality of theoretical pixel units, each of the plurality of theoretical pixel units comprises a plurality of theoretical sub-pixels having different colors; calculating a theoretical brightness value of each theoretical sub-pixel according to the image to be displayed; calculating an actual brightness value of each actual sub-pixel according to the calculated theoretical brightness value of each theoretical sub-pixel; and inputting a signal to each actual sub-pixel, so that each actual sub-pixel reaches the calculated actual brightness value. The step of calculating the actual brightness value of each actual sub-pixel according to the theoretical brightness value of each theoretical sub-pixel comprises sub-steps of: dividing, according to each color, the theoretical pixel array into a first region, a second region and a third region, wherein, for the theoretical sub-pixels of each color, an average brightness value of the theoretical sub-pixels having the color in the first region is smaller than that of the theoretical sub-pixels having the color in the second region, and the third region is located at a border of the first region and the second region; and calculating, according to each color, the actual brightness values of the actual sub-pixels corresponding to the first region, the second region and the third region, respectively, wherein, a weighted sum of the theoretical brightness value of the theoretical sub-pixel corresponding to a position of the actual sub-pixel to be calculated and the theoretical brightness value of at least one theoretical sub-pixel having the color and around the theoretical sub-pixel corresponding to the position is calculated, so as to calculate the actual brightness value of the actual sub-pixel to be calculated.

According to an embodiment of the present invention, the step of dividing, according to each color, the theoretical pixel array may comprise sub-steps of: taking four theoretical pixel units in adjacent two rows and adjacent two columns in the theoretical pixel array as a calculation unit, and obtaining the theoretical brightness values of all the theoretical sub-pixels in the calculation unit calculated based on the image to be displayed; taking at least one theoretical pixel unit in the calculation unit as a reference theoretical pixel unit; calculating a difference between the theoretical brightness value of the theoretical sub-pixel having the color in the reference theoretical pixel unit and the theoretical brightness value of the theoretical sub-pixel having said color in at least one of the remaining theoretical pixel units; and when an absolute value of the calculated difference is larger than a predetermined value, determining one side, which is divided by a perpendicular bisector of a line segment connecting the two theoretical sub-pixels involved in the calculation and includes the theoretical pixel unit containing the theoretical sub-pixel having larger theoretical brightness value to be the second region, determining the other side, which is divided by the perpendicular bisector, to be the first region, and determining the theoretical pixel units through which the perpendicular bisector passes to be the third region.

According to an embodiment of the present invention, the theoretical pixel array may comprise X rows and Y columns of theoretical pixel units, and the actual brightness value of the actual sub-pixel to be calculated is calculated according to each color by one of the following calculation methods:

$$A = \alpha_1 T(M, N) + \alpha_2 T(M, N-1) + \alpha_3 T(M, N+1); \text{ and}$$

$$A = \sum_{j=1}^{n} \sum_{i=1}^{n} \beta_{ij} T_{ij};$$

wherein, A is the actual brightness value of the actual sub-pixel to be calculated, T(M, N) is the theoretical brightness value of the theoretical sub-pixel having the color in the theoretical pixel unit in row M, column N in the theoretical pixel array corresponding to the position of the actual sub-pixel to be calculated, T(M, N−1) is the theoretical brightness value of the theoretical sub-pixel having said color in the theoretical pixel unit in row M, column N−1 in the theoretical pixel array, T(M, N+1) is the theoretical brightness value of the theoretical sub-pixel having said color in the theoretical pixel unit in row M, column N+1 in the theoretical pixel array, $T_{i,j}$ is the theoretical brightness value of the theoretical sub-pixel having said color in the theoretical pixel unit in row i, column j in a matrix consisting of n rows and n columns of theoretical pixel units, and $T_{i,j}$ includes the theoretical brightness value of the theoretical sub-pixel corresponding to the position of the actual sub-pixel to be calculated, and $$1 < M < X,\ 1 < N < Y,\ \sum_{i=1}^{3} \alpha_i = 1,\ \sum_{j=1}^{n} \sum_{i=1}^{n} \beta_{ij} = 1,\ \alpha_1 > 0,$$

$$\max(\alpha_1, \alpha_2, \alpha_3) = \alpha_1,\ n > 1.$$

The calculation method for the third region may be different from that for at least one of the first and second regions.

According to an embodiment of the present invention, a length of the theoretical sub-pixels may be the same as that of the actual sub-pixels, and each actual pixel unit may comprise three actual sub-pixels having different colors, the horizontal-to-vertical ratio of each actual sub-pixel is 2:3, or the horizontal-to-vertical ratio of each actual sub-pixel is 1:2; or the horizontal-to-vertical ratio of each actual sub-pixel is 1:1.

According to an aspect of the present invention, there is provided a display panel, which comprises the pixel array according to the present invention.

According to an aspect of the present invention, there is provided a display device, which comprises the display panel according to the present invention.

According to an embodiment of the present invention, the display device may further comprise a theoretical brightness calculation module, an actual brightness calculation module and a display driving module, wherein the theoretical brightness calculation module is used for dividing an image to be displayed according to a theoretical pixel array, which comprises a plurality of theoretical pixel units, each of which comprises a plurality of theoretical sub-pixels having different colors, and is used for calculating a theoretical brightness value of each theoretical sub-pixel according to the image to be displayed; the actual brightness calculation module is used for calculating an actual brightness value of each actual sub-pixel according to the theoretical brightness value of each theoretical sub-pixel calculated by the theoretical brightness calculation module; the display driving module is used for inputting a signal to each actual sub-pixel so that each actual sub-pixel reaches the actual brightness value calculated by the actual brightness calculation module. The actual brightness calculation module comprises: a region-dividing sub-module, used for dividing, according to each color, the theoretical pixel array into a first region, a second region and a third region, wherein, for the theoretical sub-pixels of each color, an average brightness value of the theoretical sub-pixels having the color in the first region is smaller than that of the theoretical sub-pixels having the color in the second region, and the third region is located at a border of the first region and the second region; and a calculation sub-module, which calculates, according to each color, the actual brightness values of the actual sub-pixels corresponding to the first region, the second region and the third region, respectively. The calculation sub-module calculates a weighted sum of the theoretical brightness value of the theoretical sub-pixel corresponding to a position of the actual sub-pixel to be calculated and the theoretical brightness value of at least one theoretical sub-pixel having the color and around the theoretical sub-pixel corresponding to the position, so as to calculate the actual brightness value of the actual sub-pixel to be calculated.

Compared to the prior art, in the present invention, the sub-pixel has increased width, which reduces the difficulty in manufacturing the pixel array, and improves product yield. By using the driving method according to the present invention to drive the pixel array, the granular sensation of the display panel including the pixel array can be reduced, thus achieving a display effect of a display panel with higher resolution in the same size.

BRIEF DESCRIPTION OF THE DRAWINGS

The accompanying drawings, constituting a part of the specification, are used for providing a further understanding of the present invention, and explaining the present invention in conjunction with the following specific implementations, rather than limiting the present invention. In the drawings:

FIG. 11 illustrates another example in which different calculations may be adopted for different regions of the theoretical pixel array;

FIGS. 12 to 14 illustrate examples of calculating the actual sub-pixels of various colors;

DETAILED DESCRIPTION OF THE EMBODIMENTS

Specific implementations of the present invention will be described in detail below in conjunction with the accompanying drawings. It should be understood that the specific implementations described herein are merely used for illustrating and explaining the present invention, rather than limiting the present invention.

Figure 6:
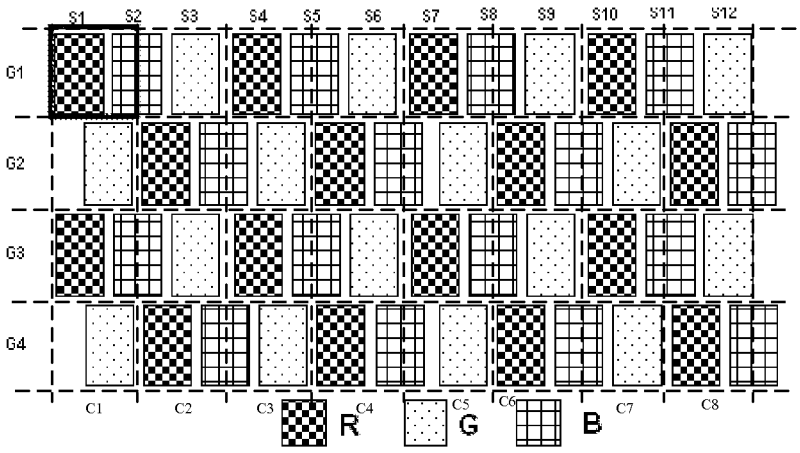
FIG. 6 is a schematic diagram of a pixel array according to an embodiment of the present invention.

FIG. 6 is a schematic diagram of a pixel array according to an embodiment of the present invention. As shown in FIG. 6, the pixel array comprises a plurality of pixel units, each of the plurality of pixel units comprises three sub-pixels having different colors (a red sub-pixel R, a green sub-pixel G and a blue sub-pixel B). A horizontal-to-vertical ratio of each sub-pixel is in a range of 1:2 to 1:1.

Figure 1:
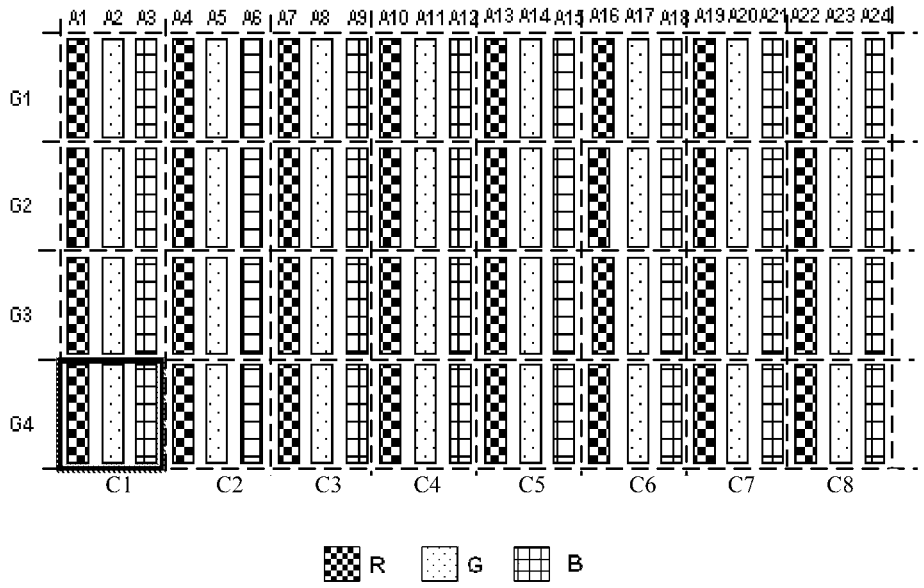
FIG. 1 is a schematic diagram of an existing pixel array, and also illustrates a manner in which a theoretical pixel array are divided into theoretical pixel units according to the present invention.
Figure 2A:
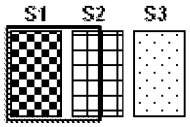
FIGS. 2*a* to 2*d* are schematic diagrams of pixel units in a pixel array according to an embodiment of the present invention.
Figure 2B:
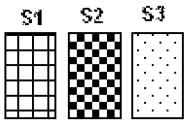
Figure 2C:
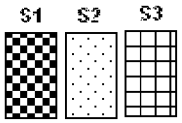
Figure 2D:
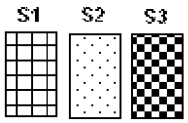

In contrast to the pixel array shown in FIG. 6, in a pixel array of the prior art shown in FIG. 1, a horizontal-to-vertical ratio of each sub-pixel is 1:3. Compared to the prior art, in the pixel array according to the present invention, the sub-pixels may have a larger width when the length thereof is the same as that of the sub-pixels in the prior art, thus facilitating processing and manufacturing. In addition, compared to the prior art, in the pixel array according to the present invention, the number of the sub-pixels in a same row is decreased, thus reducing the number of data lines required by the pixel array, and further simplifying the manufacturing process of the pixel array.

Further, a driving method according to the present invention may be used to drive the pixel array according to the present invention, so as to reduce the granular sensation of a display panel including the pixel array, and a display effect of a display panel with higher resolution in the same size is achieved. Specifically, the present invention aims to achieve the display effect of a pixel array with higher resolution, for example, as shown in FIG. 1, by using a pixel array with lower resolution, for example, as shown in FIG. 6.

It can be easily understood by a person skilled in the art that, three sub-pixels having different colors in each pixel unit may be a red sub-pixel R, a green sub-pixel G and a blue sub-pixel B. Arrangement sequence of the sub-pixels of three colors in each pixel unit is not limited in the present invention.

According to an embodiment of the present invention, as shown in FIGS. 2*a* to 2*d*, the horizontal-to-vertical ratio of each sub-pixel may be 2:3. In FIGS. 2*a* to 2*d*, arrangement sequences of the sub-pixels of three different colors are respectively illustrated, but the present invention is not limited thereto.

According to an embodiment of the present invention, the pixel array may be divided into a plurality of pixel sets, each of which may comprise two pixel units in two adjacent rows and in the same column. A left boundary of each sub-pixel of the pixel unit in a lower row may be aligned with a midpoint of a bottom boundary of a corresponding sub-pixel of the pixel unit in an upper row, as shown in FIGS. 5*a* to 5*f*. Alternatively, a left boundary of each sub-pixel of the pixel unit in an upper row may be aligned with a midpoint of a top boundary of a corresponding sub-pixel of the pixel unit in a lower row. According to such arrangement, color distribution in the pixel array can be more uniform.

The sub-pixels may comprise red sub-pixels R, green sub-pixels G and blue sub-pixels B, and arrangement sequence of the sub-pixels of three colors in each pixel unit of each pixel set is not limited in the present invention.

FIGS. 5*a* to 5*f* illustrate, by way of example, possible arrangement sequences of the sub-pixels of three colors in pixel units of each pixel set, but the present invention is not limited thereto.

Figure 3A:
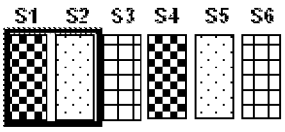
FIGS. 3*a* to 3*c* are schematic diagrams of pixel units in a pixel array according to another embodiment of the present invention.
Figure 3B:
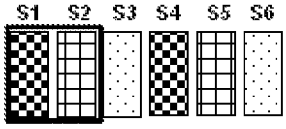
Figure 3C:
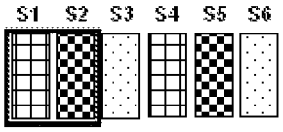
Figure 4A:
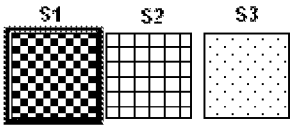
FIGS. 4*a* to 4*f* are schematic diagrams of pixel units in a pixel array according to another embodiment of the present invention.
Figure 4B:
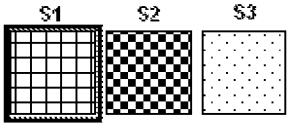
Figure 4C:
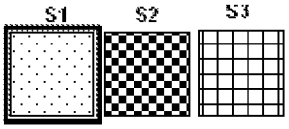
Figure 4D:
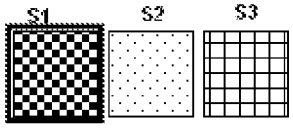
Figure 4E:
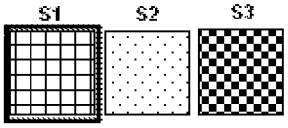
Figure 4F:
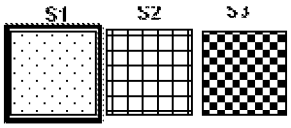
Figure 5A:
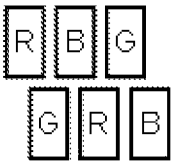
FIGS. 5*a* to 5*f* are schematic diagrams of two pixel units, which are adjacent in a same column, in a pixel array according to an embodiment of the present invention.
Figure 5B:
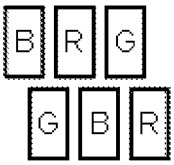
Figure 5C:
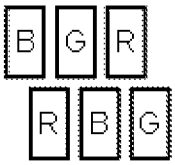
Figure 5D:
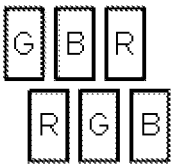
Figure 5E:
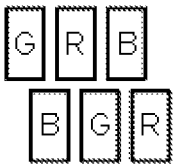
Figure 5F:
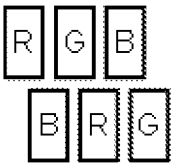

According to another embodiment of the present invention, as shown in FIGS. 3*a* to 3*c*, the horizontal-to-vertical ratio of each sub-pixel may be 1:2. In FIGS. 3*a* to 3*c*, arrangement sequences of the sub-pixels of three different colors are respectively illustrated, but the present invention is not limited thereto.

According to another embodiment of the present invention, as shown in FIGS. 4*a* to 4*f*, the horizontal-to-vertical ratio of each sub-pixel may be 1:1. In FIGS. 4*a* to 4*f*, arrangement sequences of the sub-pixels of three different colors are respectively illustrated, but the present invention is not limited thereto.

Although the pixel array is described above by taking a case where the sub-pixels of three colors are included as an example, it should be understood by a person skilled in the art that, the pixel array may include sub-pixels of four colors (e.g., Red, Green, Blue and White), and the horizontal-to-vertical ratio of each sub-pixel is in the range of 1:2 to 1:1.

According to another embodiment of the present invention, there is provided a driving method of a pixel array, the pixel array comprises a plurality of actual pixel units as shown in FIG. 6 (pixel units each constituted by three sub-pixels having different colors in FIG. 6), each of the plurality of actual pixel units comprises a plurality of actual sub-pixels having different colors, and the horizontal-to-vertical ratio of each actual sub-pixel in a range of 1:2 to 1:1. The driving method comprises steps of: dividing an image to be displayed according to a theoretical pixel array (e.g., the pixel array as shown in FIG. 1), wherein, the theoretical pixel array comprises a plurality of theoretical pixel units (portions surrounded by dashed boxes in FIGS. 1 and 6), and each theoretical pixel unit comprises a plurality of theoretical sub-pixels having different colors; calculating a theoretical brightness value of each theoretical sub-pixel according to the image to be displayed; calculating an actual brightness value of each actual sub-pixel according to the calculated theoretical brightness value of each theoretical sub-pixel; and inputting a signal to each actual sub-pixel, so that each actual sub-pixel reaches the calculated actual brightness value. The step of calculating the actual brightness value of each actual sub-pixel according to the theoretical brightness value of each theoretical sub-pixel comprises sub-steps of: dividing, according to each color, the theoretical pixel array into a first region, a second region and a third region (see FIG. 11), wherein, for the theoretical sub-pixels of each color, an average brightness value of the theoretical sub-pixels of the color in the first region is smaller than that of the theoretical sub-pixels of the color in the second region, and the third region is located at a border of the first region and the second region; and calculating, according to each color, the actual brightness values of the actual sub-pixels corresponding to the first region, the second region and the third region, respectively, wherein, a weighted sum of the theoretical brightness value of the theoretical sub-pixel corresponding to a position of the actual sub-pixel to be calculated and the theoretical brightness value of at least one theoretical sub-pixel having said color around the theoretical sub-pixel corresponding to the position is calculated, so as to calculate the actual brightness value of the actual sub-pixel to be calculated.

FIG. 1 illustrates a method for dividing the image to be displayed according to the theoretical pixel array (i.e., the theoretical pixel array expected to be achieved by using the actual pixel array shown in FIG. 6). As shown in FIG. 1, in a same row, three theoretical sub-pixels arranged sequentially form one theoretical pixel unit. In FIG. 1, 4 rows and 24 columns of theoretical sub-pixels form 4 rows and 8 columns of theoretical pixel units.

As shown in FIG. 6, in the actual pixel array according to the present invention, 4 rows and 4 columns of actual pixel units formed by 4 rows and 12 columns of actual sub-pixels are included. The present invention aims to achieve a display effect with higher resolution (theoretical value is 4×8) as shown in FIG. 1 by using the pixel array with lower resolution (actual value is 4×4) as shown in FIG. 6.

Since the image to be displayed has the same area as the pixel array, the pixel array (the theoretical pixel array shown in FIG. 1 and the actual pixel array shown in FIG. 6) may be divided into 4 rows and 8 columns of theoretical pixel units for description.

In FIG. 1, the image to be displayed is divided into 4 rows (including row G1 to row G4) and 8 columns (including column C1 to column C8) according to the theoretical pixel units; and in FIG. 6, the same division applies.

It should be understood that, "the theoretical sub-pixel corresponding to the position of the actual sub-pixel to be calculated" stated in the present invention refers to a theoretical sub-pixel whose position in the theoretical pixel array is the same as or close to a position of the actual sub-pixel to be calculated in the actual pixel array and which has the same color as the actual sub-pixel to be calculated. Two examples are used to briefly explain the above concept in the following.

In a first example, according to the actual pixel array shown in FIG. 6, a theoretical sub-pixel corresponding to a position of the actual sub-pixel in row G1, column S1 is the theoretical sub-pixel in row G1, column A1 in the theoretical pixel array shown in FIG. 1. Therefore, when calculating the actual brightness value of the actual sub-pixel in row G1, column S1 in the actual pixel array shown in FIG. 6, a part of the theoretical brightness value of the theoretical sub-pixel in row G1, column A1 in the theoretical pixel array shown in FIG. 1 and parts of the theoretical brightness values of the theoretical sub-pixels (e.g., the theoretical sub-pixel in row G1, column A4, the theoretical sub-pixel in row G2, column A1 and the theoretical sub-pixel in row G2, column A4) having the same color as and around the theoretical sub-pixel in row G1, column A1 will be used.

In a second example, when calculating the actual brightness value of the actual sub-pixel in row G2, column S2 in the actual pixel array shown in FIG. 6, the theoretical sub-pixel corresponding to a position of the actual sub-pixel in row G2, column S2 (i.e., the second actual sub-pixel from left in row G2 of the actual pixel array shown in FIG. 6) needs to be found first in the theoretical pixel array shown in FIG. 1. The theoretical sub-pixel corresponding to the position of the actual sub-pixel in row G2, column S2 in the actual pixel array shown in FIG. 6 is the theoretical sub-pixel in row G2, column A4 in the theoretical pixel array shown in FIG. 1 (a position of the theoretical sub-pixel in row G2, column A4 in the theoretical pixel array shown in FIG. 1 is closest to the position of the actual sub-pixel in row G2, column S2 in the actual pixel array shown in FIG. 6). Therefore, when calculating the actual brightness value of the actual sub-pixel in row G2, column S2 in the actual pixel array shown in FIG. 6, a part of the theoretical brightness value of the theoretical sub-pixel in row G2, column A4 in the theoretical pixel array shown in FIG. 1 and a part of the theoretical brightness value of at least one theoretical sub-pixel (including the theoretical sub-pixel in row G1, column A1, the theoretical sub-pixel in row G1, column A4, the theoretical sub-pixel in row G1, column A7, the theoretical sub-pixel in row G2, column A1, the theoretical sub-pixel in row G2, column A7, the theoretical sub-pixel in row G3, column A1, the theoretical sub-pixel in row G3, column A4 and the theoretical sub-pixel in row G3, column A7 in the theoretical pixel array shown in FIG. 1) having the same color as and around the theoretical sub-pixel in row G2, column A4 may be used.

When the pixel array according to the present invention is driven according to the above driving method, the granular sensation of the display panel including the pixel array can be reduced, thus achieving a display effect of a display panel with higher resolution in the same size.

According to an embodiment of the present invention, a length of the theoretical sub-pixel is the same as that of the actual sub-pixel, so that the theoretical sub-pixels can easily correspond to the actual sub-pixels in position.

It should be understood by a person skilled in the art that, the actual pixel unit may comprise three actual sub-pixels having different colors, i.e., the red sub-pixel R, the green sub-pixel G and the blue sub-pixel B shown in FIG. 6. Moreover, as shown in FIG. 1, the theoretical sub-pixels may include theoretical sub-pixels of a first color (e.g., red sub-pixels R), theoretical sub-pixels of a second color (e.g., green sub-pixels G) and theoretical sub-pixels of a third color (e.g., blue sub-pixels B). In this case, the theoretical pixel array shown in FIG. 1 may be divided into the first region, the second region and the third region according to each color.

When the theoretical pixel array is divided into the first region, the second region and the third region according to each color, the average brightness value of the theoretical sub-pixels of the color in the first region is smaller than that of the theoretical sub-pixels of the color in the second region, and the third region is located at the border of the first region and the second region.

It should be understood that, the first regions, the second regions and the third regions of the theoretical pixel array for respective colors may be overlapped or may not be overlapped.

The first region and the second region are continuous display regions, the third region is a boundary region, and the calculation method for the third region may be different from at least one of the calculation method for the first region and the calculation method for the second region, so that the displayed image has clearer boundary, and further the displayed image is sharp.

According to embodiments of the present invention, the theoretical pixel array may be divided into the first region (brightness of the color corresponding thereto is small), the second region (brightness of the color corresponding thereto is large) and the third region between the first region and the second region through various methods.

For example, for each color, an average value of the theoretical brightness values of the theoretical sub-pixels of the color in the theoretical pixel array (which will display the image to be displayed) may be calculated, and the theoretical brightness value of each theoretical sub-pixel of the color is compared with the calculated average value. If the theoretical brightness value of the theoretical sub-pixel is smaller than the average value, then it is determined that the theoretical pixel unit including the theoretical sub-pixel belongs to the first region of the theoretical pixel array for said color, otherwise, it is determined that the theoretical pixel unit including the theoretical sub-pixel belongs to the second region. Subsequently, the theoretical pixel units at the border of the first region and the second region are assigned to the third region for said color.

According to an embodiment of the present invention, dividing the theoretical pixel array according to each color may comprise steps of: taking four theoretical pixel units in adjacent two rows and adjacent two columns in the theoretical pixel array as a calculation unit, and obtaining the theoretical brightness values of all the theoretical sub-pixels in the calculation unit calculated based on the image to be displayed; taking at least one theoretical pixel unit in the calculation unit as a reference theoretical pixel unit; calculating a difference between the theoretical brightness value of the theoretical sub-pixel having the color in the reference theoretical pixel unit and the theoretical brightness value of the theoretical sub-pixel having said color in at least one of the remaining theoretical pixel units; when the absolute value of the calculated difference is larger than a predetermined value, determining one side, which is divided by a perpendicular bisector of a line segment connecting the two theoretical sub-pixels involved in the calculation and includes the theoretical pixel unit containing the theoretical sub-pixel with larger theoretical brightness value, to be the second region, determining the other side, which is divided by the perpendicular bisector, to be the first region, and determining the theoretical pixel units through which the perpendicular bisector passes to be the third region.

The predetermined value may be determined according to specific requirements for the display panel. For example, the theoretical brightness value of the theoretical sub-pixel in the reference theoretical pixel unit is Ya, the theoretical brightness value of the theoretical sub-pixel in another theoretical pixel unit is Yb, the predetermined value is Δ, and Δ may be in the range of 0.3Ya to 0.5Ya. In this case, the difference is Ya−Yb, and if $|Ya-Yb|>\Delta$, it is determined that the theoretical pixel unit including the theoretical sub-pixel with larger theoretical brightness value belongs to the second region, and the another theoretical pixel unit involved in the calculation belongs to the first region.

Figure 9:
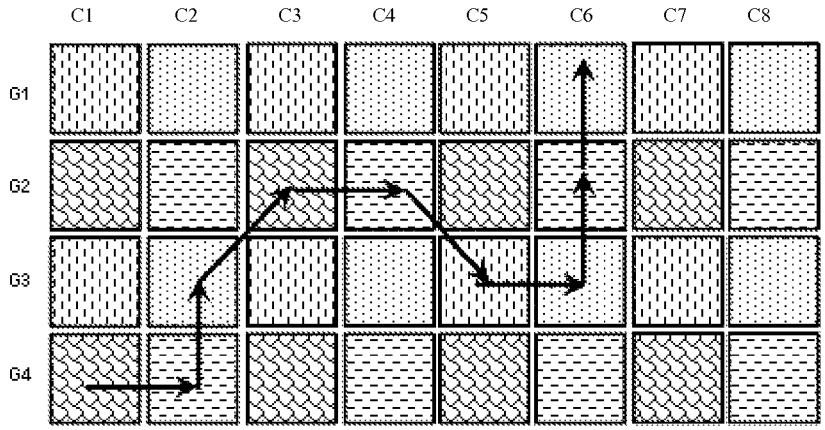
FIG. 9 illustrates that a boundary divides the theoretical pixel array into two portions.
Figure 10:
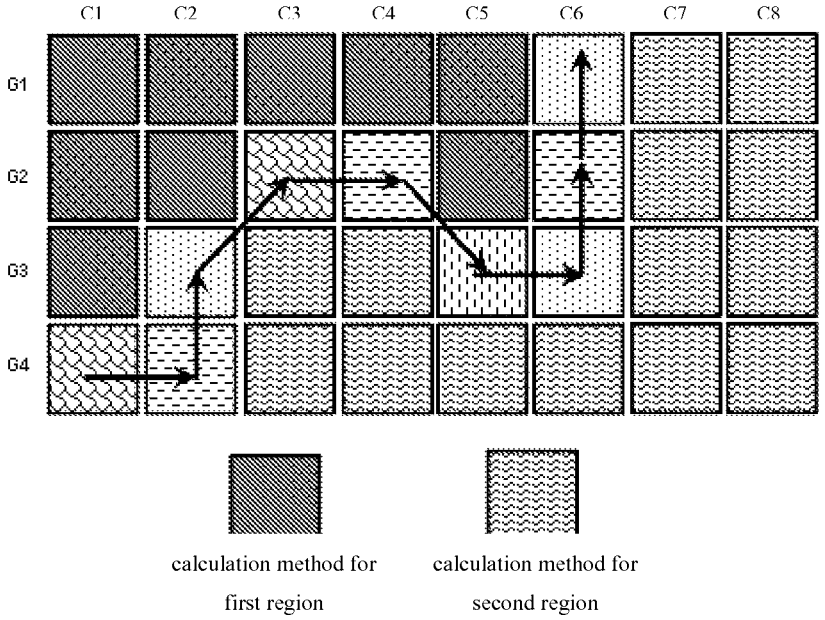
FIG. 10 illustrates an example in which different calculations may be adopted for different regions of the theoretical pixel array.

It can be easily understood that, a border (i.e., the third region) of the first region and the second region obtained according to the above dividing method is continuous, as shown in FIGS. 9 to 11. Arrows connected end to end represent a dividing line between a region with larger theoretical brightness value (i.e., the second region) and a region with smaller theoretical brightness value (i.e., the first region). If the absolute value of the difference between the brightness values of any two theoretical sub-pixels having the same color in one calculation unit is smaller than the predetermined value, it indicates that there is no border between the region with larger brightness and the region with smaller brightness in this calculation unit.

FIGS. 7*a* to 7*f* and FIG. 8 illustrate several calculation methods for the calculation unit.

Figure 7A:
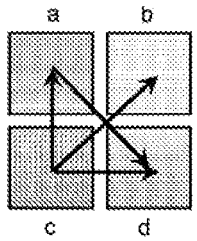
FIGS. 7*a* to 7*f* illustrate several calculation methods for calculating a boundary.
Figure 8:
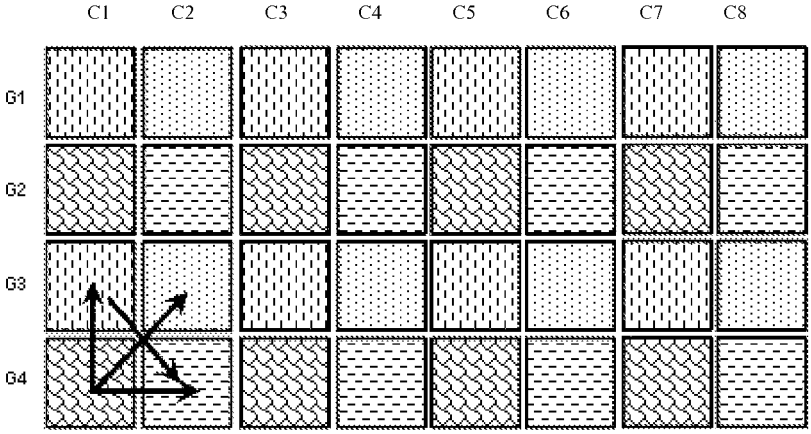
FIG. 8 illustrates that the calculation method of a boundary shown in FIG. 7*a* is applied to a pixel array so as to calculate the boundary.

As shown in FIG. 7*a* and FIG. 8, the calculation unit comprises theoretical pixel units a, b, c and d. First, the theoretical pixel unit c is taken as the reference theoretical pixel unit, and differences between the theoretical brightness value of the theoretical sub-pixel of each color in the reference theoretical pixel unit and the theoretical brightness values of the theoretical sub-pixels of the same color in the remaining three theoretical pixel units are calculated, respectively. When the difference between the theoretical brightness values of two theoretical sub-pixels of any color is larger than the predetermined value, the calculation is stopped. If the region with larger theoretical brightness value and the region with smaller theoretical brightness value cannot be divided by taking the theoretical pixel unit c as the reference theoretical pixel unit, the theoretical pixel unit a is taken as the reference theoretical pixel unit, and the difference between the theoretical brightness value of the theoretical sub-pixel of each color in the theoretical pixel unit a and the theoretical brightness value of the theoretical sub-pixel of the same color in the theoretical pixel unit d is calculated.

Figure 7B:
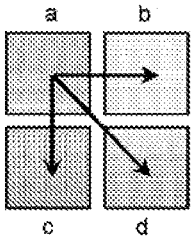

As shown in FIG. 7*b*, the calculation unit comprises the theoretical pixel units a, b, c and d. In this calculation unit, only the theoretical pixel unit a is taken as the reference theoretical pixel unit. Differences between the theoretical brightness value of the theoretical sub-pixel of each color in the theoretical pixel unit a and the theoretical brightness values of the theoretical sub-pixels of the same color in the remaining three theoretical pixel units are calculated, respectively.

Figure 7C:
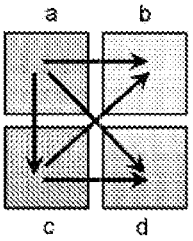

As shown in FIG. 7*c*, the calculation unit comprises the theoretical pixel units a, b, c and d. In this calculation unit, the theoretical pixel units a and c are taken as the reference theoretical pixel unit, respectively. First, the theoretical pixel unit a is taken as the reference theoretical pixel unit, and differences between the theoretical brightness value of the theoretical sub-pixel of each color in the theoretical pixel unit a and the theoretical brightness values of the theoretical sub-pixels of the same color in the remaining three theoretical pixel units are calculated, respectively. Then, the theoretical pixel unit c is taken as the reference theoretical pixel unit, and differences between the theoretical brightness value of the theoretical sub-pixel of each color in the theoretical pixel unit c and the theoretical brightness values of the theoretical sub-pixels of the same color in the theoretical pixel units b and d are calculated, respectively.

Figure 7D:
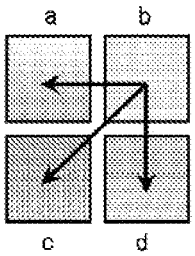

As shown in FIG. 7*d*, the calculation unit comprises the theoretical pixel units a, b, c and d. In this calculation unit, only the theoretical pixel unit b is taken as the reference theoretical pixel unit. Differences between the theoretical brightness value of the theoretical sub-pixel of each color in the theoretical pixel unit b and the theoretical brightness values of the theoretical sub-pixels of the same color in the remaining three theoretical pixel units are calculated, respectively.

Figure 7E:
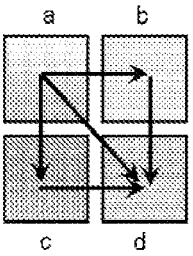

As shown in FIG. 7*e*, the calculation unit comprises the theoretical pixel units a, b, c and d. In this calculation unit, the theoretical pixel units a, b and c are taken as the reference theoretical pixel unit, respectively. Differences between the theoretical brightness value of the theoretical sub-pixel of each color in the theoretical pixel unit a and the theoretical brightness values of the theoretical sub-pixels of the same color in the remaining three theoretical pixel units are calculated, respectively. Then, the difference between the theoretical brightness value of the theoretical sub-pixel of each color in the theoretical pixel unit b and the theoretical brightness value of the theoretical sub-pixel of the same color in the theoretical pixel unit d is calculated. Subsequently, the difference between the theoretical brightness value of the theoretical sub-pixel of each color in the theoretical pixel unit c and the theoretical brightness value of the theoretical sub-pixel of the same color in the theoretical pixel unit d is calculated.

Figure 7F:
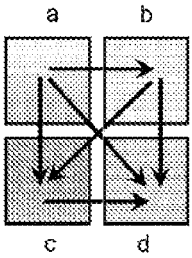

As shown in FIG. 7*f*, the calculation unit comprises the theoretical pixel units a, b, c and d. In this calculation unit, the theoretical pixel units a, b and c are taken as the reference theoretical pixel unit, respectively. First, differences between the theoretical brightness value of the theoretical sub-pixel of each color in the theoretical pixel unit a and the theoretical brightness values of the theoretical sub-pixels of the same color in the remaining three theoretical pixel units are calculated, respectively. Then, differences between the theoretical brightness value of the theoretical sub-pixel of each color in the theoretical pixel unit b and the theoretical brightness values of the theoretical sub-pixels of the same color in the theoretical pixel units c and d are calculated. Finally, the difference between the theoretical brightness value of the theoretical sub-pixel of each color in the theoretical pixel unit c and the theoretical brightness value of the theoretical sub-pixel of the same color in the theoretical pixel unit d is calculated.

According to an embodiment of the present invention, the theoretical pixel array may comprise X rows and Y columns of theoretical pixel units (FIGS. 1 and 6 illustrate 4 rows and 8 columns of theoretical pixel units), and the actual brightness value of an actual sub-pixel to be calculated may be calculated according to each color by one of the following calculation methods:

$$A = \alpha_1 T(M, N) + \alpha_2 T(M, N-1) + \alpha_3 T(M, N+1) \tag{1}$$

$$A = \sum_{j=1}^{n} \sum_{i=1}^{n} \beta_{ij} T_{ij} \tag{2}$$

wherein, A is the actual brightness value of the actual sub-pixel to be calculated, T(M, N) is the theoretical brightness value of the theoretical sub-pixel of the color in the theoretical pixel unit in row M, column N in the theoretical pixel array corresponding to the position of the actual sub-pixel to be calculated, T(M, N−1) is the theoretical brightness value of the theoretical sub-pixel of the color in the theoretical pixel unit in row M, column N−1 in the theoretical pixel array, T(M, N+1) is the theoretical brightness value of the theoretical sub-pixel of the color in the theoretical pixel unit in row M, column N+1 in the theoretical pixel array, $T_{i,j}$ is the theoretical brightness value of the theoretical sub-pixel of the color in the theoretical pixel unit in row i, column j in a matrix consisting of n rows and n columns of theoretical pixel units, and $T_{i,j}$ includes the theoretical brightness value of the theoretical sub-pixel corresponding to the position of the actual sub-pixel to be calculated, and $$1 < M < X,\ 1 < N < Y,\ \sum_{i=1}^{3} \alpha_i = 1,\ \sum_{j=1}^{n} \sum_{i=1}^{n} \beta_{ij} = 1,\ \alpha_1 > 0,$$

$$\max(\alpha_1, \alpha_2, \alpha_3) = \alpha_1,\ n > 1.$$

The theoretical sub-pixel having the same color and closest to the position of the actual sub-pixel to be calculated in the theoretical pixel array may be determined from the position of the actual sub-pixel to be calculated in the actual pixel array (referring to the above first and second examples), then the number of row M and the number of column N of the theoretical pixel unit including said theoretical sub-pixel in the theoretical pixel array is determined (formula 1), and the matrix including said theoretical pixel unit and consisting of n rows and n columns of theoretical pixel units in the theoretical pixel array may be further determined (formula 2).

FIGS. 12 and 13 illustrate examples of calculating the actual sub-pixels of various colors by using formula (2). In the implementations shown in FIGS. 12 and 13, n=2.

As shown in FIGS. 12(*a*) to 12(*d*), when the actual sub-pixel to be calculated is red, the theoretical pixel unit which includes the theoretical sub-pixel corresponding to the actual sub-pixel to be calculated is located in the M-th row and the N-th column of the theoretical pixel array. In the examples shown in FIGS. 12(*a*) to 12(*d*), the matrix consisting of 2 rows and 2 columns of theoretical pixel units in the theoretical pixel array includes the theoretical pixel unit in row M, column N (in which the theoretical brightness value of the red theoretical sub-pixel is $T_{22}$), and the theoretical pixel units adjacent to the theoretical pixel unit in row M, column N, which are the theoretical pixel unit in row M, column N−1 (in which the theoretical brightness value of the red theoretical sub-pixel is $T_{21}$), the theoretical pixel unit in row M−1, column N (in which the theoretical brightness value of the red theoretical sub-pixel is $T_{12}$) and the theoretical pixel unit in row M−1, column N−1 (in which the theoretical brightness value of the red theoretical sub-pixel is $T_{11}$), respectively.

In the example shown in FIG. 12(*a*), $\beta_{22}$ is 0.8, $\beta_{21}$ is 0, $\beta_{12}$ is 0.2 and $\beta_{11}$ is 0. Therefore, by using formula (2), the actual brightness value A of the red actual sub-pixel is calculated to be: $A=0.8T_{22}+0.2T_{12}$.

In the example shown in FIG. 12(*b*), $\beta_{22}$ is 0.7, $\beta_{21}$ is 0, $\beta_{12}$ is 0.3 and $\beta_{11}$ is 0. Therefore, by using formula (2), the actual brightness value A of the red actual sub-pixel is calculated to be: $A=0.7T_{22}+0.3T_{12}$.

In the example shown in FIG. 12(*c*), $\beta_{22}$ is 0.8, $\beta_{21}$ is −0.1, $\beta_{12}$ is 0.3 and $\beta_{11}$ is 0. Therefore, by using formula (2), the actual brightness value A of the red actual sub-pixel is calculated to be: $A=0.8T_{22}-0.1T_{21}+0.3T_{12}$.

In the example shown in FIG. 12(*d*), $\beta_{22}$ is 0.9, $\beta_{21}$ is −0.1, $\beta_{12}$ is 0.3 and $\beta_{11}$ is −0.1. Therefore, by using formula (2), the actual brightness value A of the red actual sub-pixel is calculated to be: $A=0.9T_{22}-0.1T_{21}+0.3T_{12}-0.1T_{11}$.

As shown in FIGS. 12(*e*) to 12(*h*), when the actual sub-pixel to be calculated is green, the theoretical pixel unit that includes the theoretical sub-pixel corresponding to the actual sub-pixel to be calculated is located in the M-th row and the N-th column of the theoretical pixel array. In the examples shown in FIGS. 12(*e*) to 12(*h*), the matrix consisting of 2 rows and 2 columns of theoretical pixel units in the theoretical pixel array includes the theoretical pixel unit in row M, column N (in which the theoretical brightness value of the green theoretical sub-pixel is $T_{12}$), and the theoretical pixel units adjacent to the theoretical pixel unit in row M, column N, which are the theoretical pixel unit in row M, column N−1 (in which the theoretical brightness value of the green theoretical sub-pixel is $T_{11}$), the theoretical pixel unit in row M+1, column N−1 (in which the theoretical brightness value of the green theoretical sub-pixel is $T_{21}$) and the theoretical pixel unit in row M+1, column N (in which the theoretical brightness value of the green theoretical sub-pixel is $T_{22}$), respectively.

In the example shown in FIG. 12(*e*), $\beta_{12}$ is 0.5, $\beta_{11}$ is 0.3, $\beta_{21}$ is 0 and $\beta_{22}$ is 0.2. Therefore, by using formula (2), the actual brightness value A of the green actual sub-pixel is calculated to be: $A=0.5T_{12}+0.3T_{11}+0.2T_{22}$.

In the example shown in FIG. 12(*f*), $\beta_{12}$ is 0.6, $\beta_{11}$ is 0.2, $\beta_{21}$ is 0 and $\beta_{22}$ is 0.2. Therefore, by using formula (2), the actual brightness value A of the green actual sub-pixel is calculated to be: $A=0.6T_{12}+0.2T_{11}+0.2T_{22}$.

In the example shown in FIG. 12(*g*), $\beta_{12}$ is 0.7, $\beta_{11}$ is 0.2, $\beta_{21}$ is −0.1 and $\beta_{22}$ is 0.2. Therefore, by using formula (2), the actual brightness value A of the green actual sub-pixel is calculated to be: $A=0.7T_{12}+0.2T_{11}-0.1T_{21}+0.2T_{22}$.

In the example shown in FIG. 12(*h*), $\beta_{12}$ is 0.8, $\beta_{11}$ is 0.1, $\beta_{21}$ is 0 and $\beta_{22}$ is 0.1. Therefore, by using formula (2), the actual brightness value A of the green actual sub-pixel is calculated to be: $A=0.8T_{12}+0.1T_{11}+0.1T_{22}$.

As shown in FIGS. 12(*i*) to 12(*l*), when the actual sub-pixel to be calculated is blue, the theoretical pixel unit that includes the theoretical sub-pixel corresponding to the actual sub-pixel to be calculated is located in the M-th row and the N-th column of the theoretical pixel array. In the examples shown in FIGS. 12(*i*) to 12(*l*), the matrix consisting of 2 rows and 2 columns of theoretical pixel units in the theoretical pixel array includes the theoretical pixel unit in row M, column N (in which the theoretical brightness value of the blue theoretical sub-pixel is $T_{11}$), and the theoretical pixel units adjacent to the theoretical pixel unit in row M, column N, which are the theoretical pixel unit in row M, column N+1 (in which the theoretical brightness value of the blue theoretical sub-pixel is $T_{12}$), the theoretical pixel unit in row M+1, column N (in which the theoretical brightness value of the blue theoretical sub-pixel is $T_{21}$) and the theoretical pixel unit in row M+1, column N+1 (in which the theoretical brightness value of the blue theoretical sub-pixel is $T_{22}$), respectively.

In the example shown in FIG. 12(*i*), $\beta_{11}$ is 0.8, $\beta_{12}$ is 0, $\beta_{21}$ is 0.2 and $\beta_{22}$ is 0. Therefore, by using formula (2), the actual brightness value A of the blue actual sub-pixel is calculated to be: $A=0.8T_{11}+0.2T_{21}$.

In the example shown in FIG. 12(*j*), $\beta_{11}$ is 0.7, $\beta_{12}$ is 0, $\beta_{21}$ is 0.3 and $\beta_{22}$ is 0. Therefore, by using formula (2), the actual brightness value A of the blue actual sub-pixel is calculated to be: $A=0.7T_{11}+0.3T_{21}$.

In the example shown in FIG. 12(*k*), $\beta_{11}$ is 0.8, $\beta_{12}$ is −0.1, $\beta_{21}$ is 0.3 and $\beta_{22}$ is 0. Therefore, by using formula (2), the actual brightness value A of the blue actual sub-pixel is calculated to be: $A=0.8T_{11}-0.1T_{12}+0.3T_{21}$.

In the example shown in FIG. 12(*l*), $\beta_{11}$ is 0.9, $\beta_{12}$ is −0.1, $\beta_{21}$ is 0.3 and $\beta_{22}$ is −0.1. Therefore, by using formula (2), the actual brightness value A of the blue actual sub-pixel is calculated to be: $A=0.9T_{11}-0.1T_{12}+0.3T_{21}-0.1T_{22}$.

As shown in FIGS. 13(*a*) to 13(*d*), when the actual sub-pixel to be calculated is red, the theoretical pixel unit that includes the theoretical sub-pixel corresponding to the actual sub-pixel to be calculated is located in the M-th row and the N-th column of the theoretical pixel array. In the examples shown in FIGS. 13(*a*) to 13(*d*), the matrix consisting of 2 rows and 2 columns of theoretical pixel units in the theoretical pixel array includes the theoretical pixel unit in row M, column N (in which the theoretical brightness value of the red theoretical sub-pixel is $T_{22}$), and the theoretical pixel units adjacent to the theoretical pixel unit in row M, column N, which are the theoretical pixel unit in row M, column N−1 (in which the theoretical brightness value of the red theoretical sub-pixel is $T_{21}$), the theoretical pixel unit in row M−1, column N (in which the theoretical brightness value of the red theoretical sub-pixel is $T_{12}$) and the theoretical pixel unit in row M−1, column N−1 (in which the theoretical brightness value of the red theoretical sub-pixel is $T_{11}$), respectively.

In the example shown in FIG. 13(*a*), $\beta_{22}$ is 0.8, $\beta_{21}$ is 0.1, $\beta_{12}$ is 0 and $\beta_{11}$ is 0.1. Therefore, by using formula (2), the actual brightness value A of the red actual sub-pixel is calculated to be: $A=0.8T_{22}+0.1T_{21}+0.1T_{11}$.

In the example shown in FIG. 13(*b*), $\beta_{22}$ is 0.6, $\beta_{21}$ is 0.2, $\beta_{12}$ is 0 and $\beta_{11}$ is 0.2. Therefore, by using formula (2), the actual brightness value A of the red actual sub-pixel is calculated to be: $A=0.6T_{22}+0.2T_{21}+0.2T_{11}$.

In the example shown in FIG. 13(*c*), $\beta_{22}$ is 0.5, $\beta_{21}$ is 0.3, $\beta_{12}$ is 0 and $\beta_{11}$ is 0.2. Therefore, by using formula (2), the actual brightness value A of the red actual sub-pixel is calculated to be: $A=0.5T_{22}+0.3T_{21}+0.2T_{11}$.

In the example shown in FIG. 13(*d*), $\beta_{22}$ is 0.6, $\beta_{21}$ is 0.3, $\beta_{12}$ is −0.1 and $\beta_{11}$ is 0.2. Therefore, by using formula (2), the actual brightness value A of the red actual sub-pixel is calculated to be: $A=0.6T_{22}+0.3T_{21}-0.1T_{12}+0.2T_{11}$.

As shown in FIGS. 13(*e*) to 13(*h*), when the actual sub-pixel to be calculated is green, the theoretical pixel unit that includes the theoretical sub-pixel corresponding to the actual sub-pixel to be calculated is located in the M-th row and the N-th column of the theoretical pixel array. In the examples shown in FIGS. 13(*e*) to 13(*h*), the matrix consisting of 2 rows and 2 columns of theoretical pixel units in the theoretical pixel array includes the theoretical pixel unit in row M, column N (in which the theoretical brightness value of the green theoretical sub-pixel is $T_{22}$), and the theoretical pixel units adjacent to the theoretical pixel unit in row M, column N, which are the theoretical pixel unit in row M, column N−1 (in which the theoretical brightness value of the green theoretical sub-pixel is $T_{21}$), the theoretical pixel unit in row M−1, column N (in which the theoretical brightness value of the green theoretical sub-pixel is $T_{12}$) and the theoretical pixel unit in row M−1, column N−1 (in which the theoretical brightness value of the green theoretical sub-pixel is $T_{11}$), respectively.

In the example shown in FIG. 13(*e*), $\beta_{22}$ is 0.5, $\beta_{21}$ is 0.3, $\beta_{12}$ is 0.2 and $\beta_{11}$ is 0. Therefore, by using formula (2), the actual brightness value A of the green actual sub-pixel is calculated to be: $A=0.5T_{22}+0.3T_{21}+0.2T_{12}$.

In the example shown in FIG. 13(*f*), $\beta_{22}$ is 0.4, $\beta_{21}$ is 0.4, $\beta_{12}$ is 0.2 and $\beta_{11}$ is 0. Therefore, by using formula (2), the actual brightness value A of the green actual sub-pixel is calculated to be: $A=0.4T_{22}+0.4T_{21}+0.2T_{12}$.

In the example shown in FIG. 13(*g*), $\beta_{22}$ is 0.6, $\beta_{21}$ is 0.2, $\beta_{12}$ is 0.2 and $\beta_{11}$ is 0. Therefore, by using formula (2), the actual brightness value A of the green actual sub-pixel is calculated to be: $A=0.6T_{22}+0.2T_{21}+0.2T_{12}$.

In the example shown in FIG. 13(*h*), $\beta_{22}$ is 0.7, $\beta_{21}$ is 0.2, $\beta_{12}$ is 0.2 and $\beta_{11}$ is −0.1. Therefore, by using formula (2), the actual brightness value A of the green actual sub-pixel is calculated to be: $A=0.7T_{22}+0.2T_{21}+0.2T_{12}-0.1T_{11}$.

As shown in FIGS. 13(*i*) to 13(*l*), when the actual sub-pixel to be calculated is blue, the theoretical pixel unit that includes the theoretical sub-pixel corresponding to the actual sub-pixel to be calculated is located in the M-th row and the N-th column of the theoretical pixel array. In the examples shown in FIGS. 13(*i*) to 13(*l*), the matrix consisting of 2 rows and 2 columns of theoretical pixel units in the theoretical pixel array includes the theoretical pixel unit in row M, column N (in which the theoretical brightness value of the blue theoretical sub-pixel is $T_{12}$), and the theoretical pixel units adjacent to the theoretical pixel unit in row M, column N, which are the theoretical pixel unit in row M, column N−1 (in which the theoretical brightness value of the blue theoretical sub-pixel is $T_{11}$), the theoretical pixel unit in row M+1, column N−1 (in which the theoretical brightness value of the blue theoretical sub-pixel is $T_{21}$) and the theoretical pixel unit in row M+1, column N (in which the theoretical brightness value of the blue theoretical sub-pixel is $T_{22}$), respectively.

In the example shown in FIG. 13(*i*), $\beta_{12}$ is 0.8, $\beta_{11}$ is 0, $\beta_{21}$ is 0.1 and $\beta_{22}$ is 0.1. Therefore, by using formula (2), the actual brightness value A of the blue actual sub-pixel is calculated to be: $A=0.8T_{12}+0.1T_{21}+0.1T_{22}$.

In the example shown in FIG. 13(*j*), $\beta_{12}$ is 0.6, $\beta_{11}$ is 0, $\beta_{21}$ is 0.2 and $\beta_{22}$ is 0.2. Therefore, by using formula (2), the actual brightness value A of the blue actual sub-pixel is calculated to be: $A=0.6T_{12}+0.2T_{21}+0.2T_{22}$.

In the example shown in FIG. 13(*k*), $\beta_{12}$ is 0.5, $\beta_{11}$ is 0, $\beta_{21}$ is 0.2 and $\beta_{22}$ is 0.3. Therefore, by using formula (2), the actual brightness value A of the blue actual sub-pixel is calculated to be: $A=0.5T_{12}+0.2T_{21}+0.3T_{22}$.

In the example shown in FIG. 13(*l*), $\beta_{12}$ is 0.6, $\beta_{11}$ is −0.1, $\beta_{21}$ is 0.2 and $\beta_{22}$ is 0.3. Therefore, by using formula (2), the actual brightness value A of the blue actual sub-pixel is calculated to be: $A=0.6T_{12}-0.1T_{11}+0.2T_{21}+0.3T_{22}$.

FIGS. 14(*a*) to 14(*h*) illustrate examples of calculating the actual sub-pixels of various colors by using formula (1). It should be noted that, in FIG. 14, coefficients corresponding to R2, G2 and B2 are coefficient $\alpha_1$ in formula (1); coefficients corresponding to R1, G1 and B1 are coefficient $\alpha_2$ in formula (1); and coefficients corresponding to R3, G3 and B3 are the coefficient $\alpha_3$ in formula (1).

In the example shown in FIG. 14(*a*), when the actual sub-pixel to be calculated is red, the theoretical pixel unit that includes the theoretical sub-pixel corresponding to the actual sub-pixel to be calculated is located in the M-th row and the N-th column of the theoretical pixel array, and the theoretical brightness value of the red theoretical sub-pixel in said theoretical pixel unit is T(M, N). The theoretical pixel units involved in calculation further comprise the theoretical pixel unit in row M, column N−1, in which the theoretical brightness value of the red theoretical sub-pixel is T(M, N−1), and the theoretical pixel unit in row M, column N+1, in which the theoretical brightness value of the red theoretical sub-pixel is T(M, N+1). $\alpha_2$ is 0.1, $\alpha_1$ is 0.8 and $\alpha_3$ is 0.1. Therefore, by using formula (1), the actual brightness value A of the red actual sub-pixel is calculated to be:

$$A=0.1T(M,N-1)+0.8T(M,N)+0.1T(M,N+1).$$

In the example shown in FIG. 14(*a*), when the actual sub-pixel to be calculated is green, the theoretical pixel unit that includes the theoretical sub-pixel corresponding to the actual sub-pixel to be calculated is located in the M-th row and the N-th column of the theoretical pixel array, and the theoretical brightness value of the green theoretical sub-pixel in said theoretical pixel unit is T(M, N). The theoretical pixel units involved in calculation further comprise the theoretical pixel unit in row M, column N−1, in which the theoretical brightness value of the green theoretical sub-pixel is T(M, N−1), and the theoretical pixel unit in row M, column N+1, in which the theoretical brightness value of the green theoretical sub-pixel is T(M, N+1). $\alpha_2$ is 0.1, $\alpha_1$ is 0.8 and $\alpha_3$ is 0.1. Therefore, by using formula (1), the actual brightness value A of the green actual sub-pixel is calculated to be:

$$A=0.1T(M,N-1)+0.8T(M,N)+0.1T(M,N+1).$$

In the example shown in FIG. 14(*a*), when the actual sub-pixel to be calculated is blue, the theoretical pixel unit that includes the theoretical sub-pixel corresponding to the actual sub-pixel to be calculated is located in the M-th row and the N-th column of the theoretical pixel array, and the theoretical brightness value of the blue theoretical sub-pixel in said theoretical pixel unit is T(M, N). The theoretical pixel units involved in calculation further comprise the theoretical pixel unit in row M, column N−1, in which the theoretical brightness value of the blue theoretical sub-pixel is T(M, N−1), and the theoretical pixel unit in row M, column N+1, in which the theoretical brightness value of the blue theoretical sub-pixel is T(M, N+1). $\alpha_2$ is 0.1, $\alpha_1$ is 0.8 and $\alpha_3$ is 0.1. Therefore, by using formula (1), the actual brightness value A of the blue actual sub-pixel is calculated to be:

$$A=0.1T(M,N-1)+0.8T(M,N)+0.1T(M,N+1).$$

Calculation methods in the examples shown in FIGS. 14(*b*) to 14(*h*) are similar to that in FIG. 14(*a*), and are not described repeatedly.

According to an embodiment of the present invention, as shown in FIG. 11, the calculation method for the third region may be formula (1), the calculation methods for the second and first regions may be formula (2), and vice versa.

Figure 15:
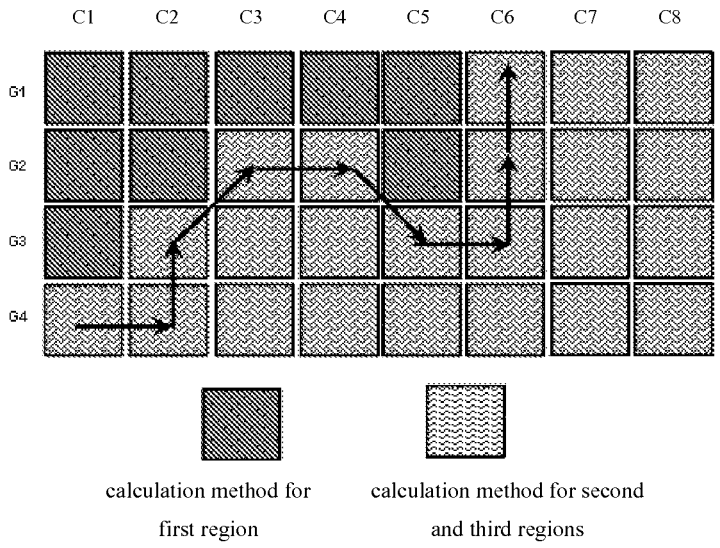
FIG. 15 illustrates an example in which a calculation method for a second region is the same as that for a third region.

According to another embodiment of the present invention, as shown in FIG. 15, the calculation method for the first region may be formula (1), the calculation methods for the second and third regions may be formula (2), and vice versa.

Figure 16:
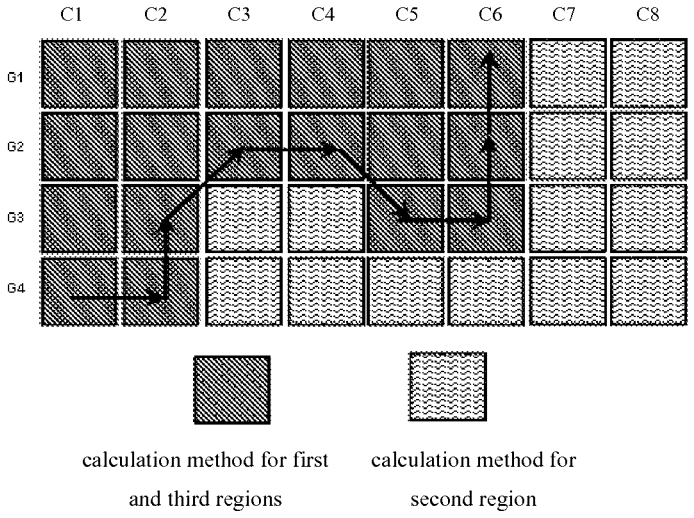
FIG. 16 illustrates an example in which a calculation method for a first region is the same as that for the third region.

According to another embodiment of the present invention, as shown in FIG. 16, the calculation method for the second region may be formula (1), the calculation methods for the first and third regions may be formula (2), and vice versa.

Similar to the pixel array according to the present invention, the driving method according to the present invention is applicable to a pixel array, in which the horizontal-to-vertical ratio of each actual sub-pixel is 2:3, or 1:2; or 1:1.

When the horizontal-to-vertical ratio of each actual sub-pixel is 2:3, the manner in which the actual sub-pixels are aligned is similar to that mentioned above, and is not described repeatedly.

According to still another aspect of the present invention, there is provided a display panel including the pixel array according to the present invention. Accordingly, the display panel according to the present invention has high aperture ratio, simple manufacture process and reduced granular sensation, and achieves a display effect of a display device with higher resolution in the same size.

According to another aspect of the present invention, there is provided a display device including the display panel according to the present invention. Accordingly, the display device according to the present invention has simple manufacture process and reduced granular sensation, and achieves a display effect of a display device with higher resolution in the same size.

The display device provided by the present invention may be driven by using the driving method according to the present invention. Accordingly, the display device may further a theoretical brightness calculation module, an actual brightness calculation module and a display driving module.

The theoretical brightness calculation module is used for dividing an image to be displayed according to a theoretical pixel array, which comprises a plurality of theoretical pixel units, each of which comprises a plurality of theoretical sub-pixels having different colors, and is used for calculating the theoretical brightness value of each theoretical sub-pixel according to the image to be displayed. The actual brightness calculation module is used for calculating the actual brightness value of each actual sub-pixel according to the theoretical brightness value of each theoretical sub-pixel calculated by the theoretical brightness calculation module. The display driving module is used for inputting a signal to each actual sub-pixel so that each actual sub-pixel reaches the actual brightness value calculated by the actual brightness calculation module.

The actual brightness calculation module may comprise: a region-dividing sub-module, which is used for dividing, according to each color, the theoretical pixel array into a first region, a second region and a third region, wherein, for the theoretical sub-pixels of each color, an average brightness value of the theoretical sub-pixels of the color in the first region is smaller than that of the theoretical sub-pixels of the color in the second region, and the third region is located at a border of the first region and the second region; and a calculation sub-module, which calculates, according to each color, the actual brightness values of the actual sub-pixels corresponding to the first region, the second region and the third region, respectively. The calculation sub-module calculates a weighted sum of the theoretical brightness value of the theoretical sub-pixel corresponding to a position of the actual sub-pixel to be calculated and the theoretical brightness value of at least one theoretical sub-pixel having the color and around the theoretical sub-pixel corresponding to the position, so as to calculate the actual brightness value of the actual sub-pixel to be calculated.

As described above, the driving method according to the present invention can be implemented by the above modules, so as to reduce the granular sensation of the display device according to the present invention, and achieve a display effect of a display device with higher resolution in the same size.

The display panel or the display device according to the present invention may be implemented as any product or component with display function, such as a liquid crystal panel, an electronic paper, an organic light-emitting diode (OLED) panel, a liquid crystal television, a liquid crystal display, a digital photo frame, a mobile phone, a tablet computer, or the like.

It can be understood that, the above implementations are merely exemplary implementations used for explaining the principle of the present invention, but the present invention is not limited thereto. For those skilled in the art, various modifications and improvements may be made without departing from the spirit and essence of the present invention, and these modifications and improvements are also deemed as falling within the protection scope of the present invention.

The invention claimed is:

1. A driving method for a pixel array, wherein, the pixel array comprises a plurality of actual pixel units, each of the plurality of actual pixel units comprises a plurality of actual sub-pixels having different colors, a horizontal-to-vertical ratio of each actual sub-pixel is in a range of 1:2 to 1:1, and the driving method comprises steps of:

dividing an image to be displayed according to a theoretical pixel array comprising a plurality of theoretical pixel units, each of the plurality of theoretical pixel units comprises a plurality of theoretical sub-pixels having different colors;

calculating a theoretical brightness value of each theoretical sub-pixel according to the image to be displayed;

calculating an actual brightness value of each actual sub-pixel according to the calculated theoretical brightness value of each theoretical sub-pixel;

inputting a signal to each actual sub-pixel, so that each actual sub-pixel reaches the calculated actual brightness value, wherein, the step of calculating the actual brightness value of each actual sub-pixel according to the theoretical brightness value of each theoretical sub-pixel comprises sub-steps of:

dividing, according to each color, the theoretical pixel array into a first region, a second region and a third region, wherein, for the theoretical sub-pixels of each color, an average brightness value of the theoretical sub-pixels having the color in the first region is smaller than that of the theoretical sub-pixels having the color in the second region, and the third region is located at a border of the first region and the second region; and calculating, according to each color, the actual brightness values of the actual sub-pixels corresponding to the first region, the second region and the third region, respectively, wherein, a weighted sum of the theoretical brightness value of the theoretical sub-pixel corresponding to a position of the actual sub-pixel to be calculated and the theoretical brightness value of at least one theoretical sub-pixel having the color and around the theoretical sub-pixel corresponding to the position is calculated, so as to calculate the actual brightness value of the actual sub-pixel to be calculated, wherein, the step of dividing, according to each color, the theoretical pixel array comprises sub-steps of:

taking four theoretical pixel units in adjacent two rows and adjacent two columns in the theoretical pixel array as a calculation unit, and obtaining the theoretical brightness values of all the theoretical sub-pixels in the calculation unit calculated based on the image to be displayed;

taking at least one theoretical pixel unit in the calculation unit as a reference theoretical pixel unit;

calculating a difference between the theoretical brightness value of the theoretical sub-pixel having the color in the reference theoretical pixel unit and the theoretical brightness value of the theoretical sub-pixel having said color in at least one of the remaining theoretical pixel units; and when an absolute value of the calculated difference is larger than a predetermined value, determining one side, which is divided by a perpendicular bisector of a line segment connecting the two theoretical sub-pixels involved in the calculation and includes the theoretical pixel unit containing the theoretical sub-pixel having larger theoretical brightness value to be the second region, determining the other side, which is divided by the perpendicular bisector, to be the first region, and determining the theoretical pixel units through which the perpendicular bisector passes to be the third region; and providing a display output to drive a display panel comprising a pixel array having a predetermined size providing predetermined resolution to achieve a display effect of a display device with higher resolution in the same size.

2. The driving method according to claim 1, wherein, the theoretical pixel array comprises X rows and Y columns of theoretical pixel units, and the actual brightness value of the actual sub-pixel to be calculated is calculated according to each color by one of the following calculation methods:

$$A = \alpha_1 T(M, N) + \alpha_2 T(M, N-1) + \alpha_3 T(M, N+1); \text{ and}$$

$$A = \sum_{j=1}^{n} \sum_{i=1}^{n} \beta_{ij} T_{ij};$$

wherein,

A is the actual brightness value of the actual sub-pixel to be calculated,

T(M, N) is the theoretical brightness value of the theoretical sub-pixel having the color in the theoretical pixel unit in row M, column N in the theoretical pixel array corresponding to the position of the actual sub-pixel to be calculated, T(M, N−1) is the theoretical brightness value of the theoretical sub-pixel having said color in the theoretical pixel unit in row M, column N−1 in the theoretical pixel array, T(M, N+1) is the theoretical brightness value of the theoretical sub-pixel having said color in the theoretical pixel unit in row M, column N+1 in the theoretical pixel array, $T_{i,j}$ is the theoretical brightness value of the theoretical sub-pixel having said color in the theoretical pixel unit in row i, column j in a matrix consisting of n rows and n columns of theoretical pixel units, and $T_{i,j}$ includes the theoretical brightness value of the theoretical sub-pixel corresponding to the position of the actual sub-pixel to be calculated, and $$1 < M < X,\ 1 < N < Y,\ \sum_{i=1}^{3} \alpha_i = 1,\ \sum_{j=1}^{n} \sum_{i=1}^{n} \beta_{ij} = 1,\ \alpha_1 > 0,$$

$$\max(\alpha_1, \alpha_2, \alpha_3) = \alpha_1,\ n > 1,$$

wherein, the calculation method for the third region is different from that for at least one of the first and second regions.

3. The driving method according to claim 1, wherein, a length of the theoretical sub-pixels is the same as that of the actual sub-pixels, and each actual pixel unit comprises three actual sub-pixels having different colors, the horizontal-to-vertical ratio of each actual sub-pixel is 2:3, or the horizontal-to-vertical ratio of each actual sub-pixel is 1:2; or the horizontal-to-vertical ratio of each actual sub-pixel is 1:1.

* * * * *